US012486080B2

(12) United States Patent
Donnet et al.

(10) Patent No.: US 12,486,080 B2
(45) Date of Patent: Dec. 2, 2025

(54) DISPENSING DEVICE, DISPENSING SYSTEM AND METHOD FOR DISPENSING POWDER

(71) Applicant: FERTON HOLDING S.A., Delémont (CH)

(72) Inventors: Marcel Donnet, St. Jean de Gonville (FR); Florent Beani, Gex (FR); James Crozier, Cully (CH); Maxime Fournier, Lausanne (CH)

(73) Assignee: FERTON HOLDING S.A., Delémont (CH)

( * ) Notice: Subject to any disclaimer, the term of this patent is extended or adjusted under 35 U.S.C. 154(b) by 304 days.

(21) Appl. No.: 18/022,780

(22) PCT Filed: Aug. 13, 2021

(86) PCT No.: PCT/EP2021/072592
§ 371 (c)(1),
(2) Date: Feb. 23, 2023

(87) PCT Pub. No.: WO2022/043094
PCT Pub. Date: Mar. 3, 2022

(65) Prior Publication Data

US 2023/0312183 A1 Oct. 5, 2023

(30) Foreign Application Priority Data

Aug. 25, 2020 (EP) ..... 20192680

(51) Int. Cl.
*B65D 1/02* (2006.01)
*B65D 39/08* (2006.01)
(Continued)

(52) U.S. Cl.
CPC ..... *B65D 39/08* (2013.01); *B65D 1/0207* (2013.01); *B65D 47/06* (2013.01); *B65D 51/1611* (2013.01); *B65D 2547/06* (2013.01)

(58) Field of Classification Search
CPC ..... B65D 39/08; B65D 1/0207; B65D 47/06; B65D 51/1611; B65D 2547/06; B65D 85/70
See application file for complete search history.

(56) References Cited

U.S. PATENT DOCUMENTS 1,602,126 A 10/1926 Russell
1,913,393 A * 6/1933 Jones ..... B43L 25/002 222/482
(Continued)

FOREIGN PATENT DOCUMENTS

JP H0231864 A 2/1990
JP 2004513761 A 5/2004
WO 102015201871 A1 8/2016

OTHER PUBLICATIONS

International Search Report for corresponding application PCT/EP2021/072592 filed Aug. 13, 2021; Mail date Nov. 8, 2021.
(Continued)

*Primary Examiner* — Frederick C Nicolas
(74) *Attorney, Agent, or Firm* — CANTOR COLBURN LLP

(57) ABSTRACT

A dispensing device for dispensing a powder preferably from a closed container, the device including a first side, a second side, a powder passage extending through the device and being configured to transfer powder from the first side to the second side, and a ventilation passage extending through the device and being configured to transfer ambient air from the second side to the first side, where the ventilation passage has a first passage length from the surface of the second side up to its ventilation opening and, the powder
(Continued)

passage has a second passage length from the surface of the second side up to its powder opening, where the first passage length is larger than the second passage length.

15 Claims, 4 Drawing Sheets

(51) Int. Cl.
*B65D 47/06* (2006.01)
*B65D 51/16* (2006.01)

(56) References Cited

U.S. PATENT DOCUMENTS 2,387,699 A * 10/1945 Bates ..... B65D 51/10 222/479
2,812,120 A 11/1957 Beall, Jr.
3,168,221 A 2/1965 Parker
5,211,318 A * 5/1993 Govatzidakis ..... B65D 47/06 222/533
5,465,875 A * 11/1995 Garnett ..... B67D 7/0294 222/481.5
5,472,121 A 12/1995 Silano
6,230,944 B1 * 5/2001 Castellano ..... B65D 47/243 222/481.5
6,742,678 B1 * 6/2004 Krystopik, Jr. ..... B65D 47/122 222/481.5
7,172,099 B2 * 2/2007 Hofte ..... A47L 13/22 222/481.5
7,527,180 B2 * 5/2009 Allen ..... B65D 47/06 222/481.5
7,845,524 B2 * 12/2010 Evans ..... G01F 11/26 222/442
8,245,882 B1 * 8/2012 Federighi ..... B01F 23/2323 222/481.5
10,647,479 B2 * 5/2020 Limbrey ..... B65D 47/0876
11,618,612 B2 * 4/2023 Stratton ..... B65D 25/48 222/481.5
2001/0031376 A1 10/2001 Fulton
2006/0091153 A1 5/2006 Evans et al.
2012/0111893 A1 * 5/2012 Luebke ..... B65D 47/32 222/481.5
2013/0104939 A1 * 5/2013 Shibata ..... B05B 11/04 134/25.1
2015/0060499 A1 * 3/2015 Silvers ..... B65D 47/06 222/481.5
2015/0122839 A1 * 5/2015 Agassi ..... B65D 47/12 222/481.5
2019/0071299 A1 3/2019 Briggs

OTHER PUBLICATIONS

Written Opinion for corresponding application PCT/EP2021/072592 filed Aug. 13, 2021; Mail date Nov. 8, 2021.
International Preliminary Report on Patentabilty for corresponding application PCT/EP2021072592 filed Aug. 13, 2021; Mail date Feb. 28, 2023.

* cited by examiner

DISPENSING DEVICE, DISPENSING SYSTEM AND METHOD FOR DISPENSING POWDER

TECHNICAL FIELD

The present disclosure relates to a dispensing device for dispensing a powder, a dispensing system and a method for dispensing powder, specifically a dental powder.

BACKGROUND

Powders may be used in an air-polishing technique used in the dental field in order to remove stains and coloration from the tooth and to remove dental biofilms. This powder blasting technique usually uses a low abrasive powder.

Using powders in the dental cavity generates dust, either during the device preparation or during the treatment. This dust is not desirable. In order to avoid this problem, soluble powders are chosen which cannot stay in the body because they will dissolve in water.

Nevertheless, the usage of water-soluble powders induces ageing difficulties: the air humidity may create some water layer on top of the particles of the powder which will then modify the particles in terms of particle size (i.e. agglomeration of particles) and flowability behavior. It can also induce powder crystallography changes which may affect powder properties. The final consequence of this humidity attack is that the powder may not work anymore in the used discharge devices because of loss of flowability properties. In particular, powder clogs inside the discharge devices may be created and the abrasiveness or efficiency properties of the powder may be lost. In other words, the powder deteriorates (i.e. the powder ages) while being stored a certain time.

Therefore, it is essential to protect the powder against humidity coming from the air. In the prior art, soft pouches are used to fill up and store the powders. These pouches have an aluminum foil in between in order to ensure a better humidity barrier. The issue is first that these pouches are single use dosages. The second issue is that the long sealing around the pouch is the weak part where the humidity can enter and equilibrate with the external humidity. Further, metallic canisters are used to protect the powder. But such canisters are not suitable to be used for prophylaxis powders because the filling up of the powder into the discharge device is impractical and cumbersome. Further, due to the rigidity of the metallic canister, the power can not be pushed out of the canister by deforming the canister. As a result, powder is either clogging the pouring spout or comes out in spills, thereby correct dosage is impossible. In addition, there may be some powder left within the canister that can not be properly discharged.

BRIEF SUMMARY

Therefore, the present disclosure provideS a dispensing device, a dispensing system and a method for dispensing powder allowing a defined dispension of powder out of a closed container which prevents or suppresses the aging of the powder.

According to a first aspect of the present disclosure a dispensing device for dispensing a powder preferably from a closed container is provided, wherein the device has a first side and a second side, the dispensing device comprising: a powder passage extending through the device and being configured to transfer powder from the first side to the second side, and a ventilation passage extending through the device and being configured to transfer ambient air from the second side of the device to the first side of the device, wherein the ventilation passage has a first passage length from the surface of the second side up to its ventilation opening, wherein the powder passage has a second passage length from the surface of the second side up to its powder opening, and wherein the first passage length is larger than the second passage length.

Preferably, such ventilation passage has an inner portion, inside the dispensing device, extending in between the first side, which faces the inside of the bottle, when used and the second side, which faces away from the bottle, when used and an external portion extending outside of the device at the first side, into a direction opposite to the second side. That means that the external portion may extend away from the first side in any angle between 0° and 180°, preferably 30°-150°, seen from a plane being perpendicular to a direction defined by connecting the first side and the second side.

In particular, it is provided that the dispensing device is intended to dispense a powder from a reservoir, the first side facing to the reservoir and the second side facing away from the reservoir. This applies for a dispensing device, being mounted to a container or a dispensing device being a head section of a container, i.e. in a case, in which the dispensing device is a permanent component of the container or being integral part of the container.

According to an aspect of the disclosure, the dispensing device is a dispensing cap. Further, the dispensing device has a circular shape in a plane view. The dispensing device has a body through which the powder passage and the ventilation passage extend. Using the dispensing device, a powder may be dispensed out of a container in a defined manner. That is, the powder may be discharged out of the container through the powder passage in a regulated or dosed manner. Even if the powder is to be filled into a relatively small cavity or volume, the dispensing device could be used to dispense the powder accordingly in a controllable and smooth manner. The container has a cylindrical shape (e.g. a bottle) and an opening at an axial side thereof. That is, if the container is in an upright position, the opening is at an uppermost position of the container.

This effect is achieved by providing the ventilation passage through which air may enter into the container during a dispensing process. That is, through the powder passage only powder may be discharged out of the container. Simultaneously, air may be introduced into the container so as to compensate for a loss of volume created by the exiting powder. As a result, the flow of powder through the powder passage is continuous and smooth without any flush effects. Flush effects may occur in case powder is transferred through a passage and air is sucked through the same passage in an opposite direction. According to the present disclosure the introduction of air into the container and the discharging of powder out of the container is well separated from each other. Consequently, the outflow of the powder is easy controllable by inclining the bottle, for example.

According to a further aspect of the disclosure, in order to secure an appropriate air introduction for compensating for the volume of powder discharged out of the container, the ventilation passage has a longer passage length as compared to the powder passage, measured from the surface of the second side towards the opening of the respective passage. Accordingly, the ventilation opening located within the container is in communication with the air volume within the container when in a discharge position or an inclined position (i.e. is located above the powder) during the dispensing process. Such discharge position is an inclined position where the powder can leave the container, especially once the container is inclined with regard to a plane being perpendicular to the axis of gravity in such way that powder flows out of the container.

Further, the ventilation passage protrudes into the container if the dispensing device is attached to the container. On the other hand, the powder opening is flush with the surface of the first side of the dispensing device. As a result, the whole powder accommodated within the container may be discharged out of the container. Alternatively, the powder passage also protrudes into the container. In any case, the passage length of the ventilation passage is longer than that of the powder passage. As a result, the respective opening is located at a specified position which suits best for the respective function. That is, the opening of the powder passage (i.e. the powder opening) is arranged such that the opening is in communication with the powder accommodated within the container. On the other hand, the opening of the ventilation passage (i.e. the ventilation opening) is arranged such that it is in communication with the air volume within the container. The above locations depend on the shape and configuration of the container. Further, it depends on the amount of powder accommodated within the container. Generally, it is advantageous to locate the powder opening such that it is located at the lowest position of the container if the container is in the discharge position. On the other hand, the ventilation opening is located at a higher position within the container relative to the powder opening and with respect to the direction of gravity.

According to a further aspect of the disclosure, the extension of the ventilation passage into the container (i.e. a protrusion amount from the first side) is longer than the extension of the powder passage from the first side. In addition, the portion of the ventilation passage extending from the first side of the dispensing device is flexible. As a result, it can be easily inserted through an opening of the container into the container if the dispensing device is attached to the container. For example, the extension of the ventilation passage is made of a flexible material such as rubber or plastic and/or includes a joint so as to be flexible.

The extension of the ventilation passage is referred to as an external portion of the ventilation passage.

According to an aspect of the disclosure, the ventilation passage includes a check valve configured to block powder trying to pass through the ventilation passage from the first side to the second side. That is, the check valve allows air to pass from the second side to the first side of the dispensing device, but is configured to prevent powder from exiting the container through the ventilation passage. Alternatively or additionally, the ventilation passage includes a sieve member which is configured to prevent the powder from exiting the container through the ventilation passage. Accordingly, even if some powder enters the ventilation passage through the ventilation opening, the powder could not pass through the ventilation passage to the second side of the dispensing device. The sieve member is arranged at the joint of the external portion and an inner portion of the ventilation passage being located within the dispensing device.

According to an aspect of the disclosure, the powder is a low abrasive dental powder such as sodium bicarbonate, glycine, calcium carbonate, aluminum trihydroxide, erythritol, hydroxylapatite, tagatose or trehalose. Further, the powder has hydrophilic properties such that the humidity of the surrounding air will create a water layer on top of the particles of the powder which may negatively influence the properties of the powder. This effect takes some time and is considered as aging of the powder.

According to an aspect of the disclosure, in order to avoid or slowdown said aging of the powder, the powder is stored in a closed container. The container is air tight such that humidity does not enter into the container. The container has an opening at which the dispensing device is attached. Further, the opening of the container is the only opening of the container. In addition, the container is made of a rigid material. Accordingly, the container is configured to be not readily deformable by a user. That is, the container cannot be compressed for pushing out the powder, for example. The container is made of aluminum. The container has a wall thickness of at least 0.05 mm, preferably between 0.3 mm and 1.2 mm, more preferably about 0.9 mm. The dispensing device is attached to the container by an engagement mechanism. The engagement mechanism is a snap mechanism that allows a fast an easy attachment of the dispensing deice to the container. In addition, the engagement mechanism is configured to attach the dispensing device in a sealed manner to the container. Accordingly, the dispensing device includes a sealing means (e.g. a sealing ring) which is sandwiched between the dispensing device and the container so as to seal the container. Further, the engagement mechanism is a thread.

According to an aspect of the disclosure, the first side of the dispensing device and the second side of the dispensing device are opposite to each other. If the dispensing device is attached to a container, the first side faces to the inside of the container and the second side faces to the outside of the container. The dispensing device has a first surface on its first side and a second surface on its second side. The first and the second side are orthogonal to a central axis of the dispensing device.

According to an aspect of the disclosure, the powder passage is a tubular passage extending through the dispensing device. The powder passage extends through a central point of the dispensing device. In other words, the powder passage is arranged within the dispensing device so as to be centralized (e.g. in case in which the dispensing device has a circular shape). As a result, the powder passage is located at a lower position with respect to the ventilation passage if the container is inclined and in the discharge position. Therefore, the powder is easily transferred through the powder passage.

According to an aspect of the disclosure, the ventilation passage is a tubular passage extending through the dispensing device. The ventilation passage has a smaller diameter as compared to that of the powder passage. Therefore, powder is not easily discharged by the ventilation passage. Further, the ventilation passage is eccentrically arranged in the dispensing device. That is, the ventilation passage is arranged at an edge portion of the dispensing device. As a result, the ventilation passage is located at a higher position with respect to the powder passage if the container is in its discharge position. As a result, air enters into the container through the ventilation passage rather than through the powder passage.

According to a further aspect of the present disclosure, the first passage length and the second passage length are measured from the surface of the dispensing device facing to the second side to an end (i.e. an opening) of the respective passage arranged opposite. Further, the passage length is the length of a central line of the respective passage. In other words, the passage length is the developed length of the central line of the respective passage. The openings of the passages opposite to the second side are considered as the end of the respective passage. In more detail, at the powder opening at or near the first side powder may enter into the powder passage. Similarly, at the ventilation opening at the opposite side of the second side, air may exit the ventilation passage. In addition, the dispensing device includes a check valve within the powder passage so as to prevent foreign substances (e.g. water, air etc.) from entering through the powder passage into the container. Moreover, the ventilation passage includes a check valve so as to prevent powder from being discharged out of the container through the ventilation passage (as described above). Therefore, each of the passages is used for the very purpose for which it is configured.

With respect to the prior art, an aspect of the present disclosure provides a dispensing device that is used to dispense a powder (e.g. a dental powder) out of a rigid container in a defined an accurately controllable manner. This goal is achieved by inter alia providing a ventilation passage that introduces air into the container during a dispensing process. As a result, the powder is smoothly discharged out of the container. In addition, the present disclosure is particularly advantageous if the container is almost empty or when there is only a little amount of powder within the container. This is because a vacuum, which is created by reducing the powder volume within the container by discharging powder, is suppressed by introducing air through the ventilation passage. On the other hand, if there is a lot of powder within the container, the powder pushes itself out of the container due to gravity (i.e. effect of the created vacuum is much less). Further, it is to be noted, that even if the ventilation opening is submerged within powder, air may still enter into the container through the ventilation passage. The configuration of the present aspect of the disclosure provides inter alia the effect that the air uses the ventilation passage to enter into the container rather than the powder passage. Thus, the powder is smoothly discharged through the powder passage.

Preferably the ventilation passage has an inner portion extending within the device and an external portion extending outside of the device at the first side.

According to a further aspect of the present disclosure, the external portion protrudes into the container if the dispensing device is attached to the container. The external portion is made of a different material as compared to the inner portion. For example, the external portion is made of a flexible material. The inner portion or internal portion is a through hole extending through the dispensing device. The external portion is a tube or hose connected to the dispensing device at the first surface so as to be in communication with the inner portion. The external portion has a sufficient rigidity and/or elasticity so as to always return to its operational position. In the operational position the external portion is in communication with the air volume within the container. In other words, in the operational position, the ventilation opening is located at a higher location as compared to that of the powder opening. As a result, air is introduced into the container if powder is discharged out of the container. Moreover, the external portion is curved so as to describe a half circle. That is, the ventilation opening faces the first side of the dispensing device. Alternatively, the external portion is curved so as to describe a quarter circle, for example. Hence, the ventilation opening is located well apart from the powder opening. In addition, the ventilation passage has a curved course. For example, the ventilation passage has a course or path that describes at least one circular. Consequently, a transfer of powder through the ventilation passage is avoided during the dispensing process.

According to a further aspect of the disclosure, the powder passage extends along a central axis of the dispensing device. Further, the inner portion extends parallel to the powder passage and the external portion is inclined with respect to the central axis. Further, the external portion is inclined with respect to the central axis. As a result, the external portion is in communication with the air volume inside the container and the ventilation opening is spaced apart from the powder opening. Hence, air is easily introduced into the container by the ventilation passage if the container is inclined.

Preferably, the external portion is inclined with respect to the powder passage.

According to a further aspect of the disclosure, the external portion is inclined with respect to at least a part of the powder passage. For example, the external portion is inclined with respect to an axial axis of the powder opening at or near the first side of the dispensing device. Hence, the ventilation opening and the powder opening are well separated from each other. As a result, the discharge of powder through the powder passage and the introduction of air through the ventilation passage is smoothly executed.

According to a further aspect of the disclosure, a passage length of the inner portion and a passage length of the external portion are essentially the same. As a result, the flow resistance for air flowing through the ventilation passage is in an optimal relation to a prevention of transferring powder through the ventilation passage.

Preferably, the powder passage has a protrusion portion protruding from the second side of the device.

According to a further aspect of the disclosure, the protrusion portion (in the following simply referred as protrusion) is an extension of the powder passage from the second surface of the second side of the dispensing device. Alternatively, the protrusion has a different cross section as compared to the powder passage extending through the dispensing device. Preferably the cross section of the protrusion provides an increased discharge cross section for the powder. That is, due to the increased cross section the powder flow speed is reduced. As a result, the user can appropriately dose the powder. Further, for example, the protrusion has a triangular cross section such that the powder can be defined dispensed. That is, a user is in a position to accurately dose the amount of powder that is to be dispensed. Further, the protrusion has a cross section that is open to one side. That is, the protrusion is configured as a duct. As a result, the user recognizes in good time how much powder is transferred by the powder passage and can therefore adapt the angle of inclination of the container. Therefore, the amount of powder discharged out of the container can be well regulated.

Preferably, the protrusion portion has a spout extending from the protrusion portion.

According to a further aspect of the disclosure, the spout further improves the dispensability of the powder. Further, the spout has a tapered shape such that its cross sections decreases if it goes towards the tip of the spout. Therefore, the dispensing device may be used to refill devices having only small refill openings. Even in this case a user is in a position to easily dispense powder out of the container without spilling powder off target.

Preferably, the spout is arranged at the protrusion portion so as to be located at the opposite side of the ventilation passage with respect to the powder passage.

According to a further aspect of the disclosure, the spout is arranged at the protrusion only in a section extending over maximally one half of the protrusion cross section. That is, on the other half of the protrusion cross section there is no spout provided. As a result, the spout is additionally used as a mark in order to identify how the container has to be inclined such that the ventilation passage is above the powder passage with respect to gravity. Therefore, the spout is located at the opposite side as the ventilation passage with respect to an axial axis of the powder passage. Moreover, since the user automatically uses the spout for supporting a defined discharge of powder out of the container, the user automatically holds and inclines the container in the favorable direction and orientation. That is, in the operational position in which the ventilation passage is arranged above the powder passage. Thus, a defined discharge of the powder out of the container is attained while air is smoothly introduced through the ventilation passage into the container.

Preferably, the dispensing device includes an external thread such that the device may be screwed to a thread on an opening of a container such that the first side is facing the inside of the container.

According to a further aspect of the disclosure, a screw thread is formed on an outside of a body of the dispensing device. The body has a shape of a cone or cylinder. The thread is configured to securely hold the dispensing device at the container. That is, the thread provides a sufficient number of convolutions, preferably 2 to 5 convolutions.

Preferably, the dispensing device includes a sealing means on its outer circumference.

According to a further aspect of the disclosure, the sealing means is a sealing ring that is arranged at the dispensing device so as to surround the dispensing device. If the dispensing device is attached to a container, the sealing means is sandwiched between the dispensing device and the container. The sealing means is configured to hinder humidity from entering into the container if the dispensing device is attached to the container.

Preferably, powder is transported through the powder passage along an ejection direction, wherein the powder passage has a cross section with a first (area) size measured in a plane, being perpendicular to the ejection direction and the ventilation passage has a cross section with a second (area) size, measured in the plane perpendicular to the ejection direction, wherein a ratio of the second size to the first size is smaller than 0.75, preferably smaller than 0.4, more preferably smaller than 0.25 and most preferably smaller than 0.1. It turned out that it is possible to dimension the ventilation passage significantly smaller than the powder passage. As a result, it is possible to use a comparable large first cross section for transporting powder. In other words: the ventilation passage does not affect the size of the powder passage. Furthermore, the amount of exchanged gas is limited.

Preferably, the second size of the cross section of the ventilation passage increases from the second side to the ventilation opening.

In particular, the powder passage extends straight and/or has a cross section with a constant first cross section along its extension from the second side to the powder opening, the first cross section, being measured along a direction being parallel to the ejection direction, along which the powder is transported. Thus, it is advantageously possible to avoid turbulences during the transport of the powder inside the powder passage.

Especially, the dispending device has a cylindrical basic shape having a central axis, wherein—measured in a radial direction with respect to the central axis—a first distance is established between an opening of the ventilation passage and an opening of the powder passage at the second side, and a second distance is established between the powder opening and the ventilation opening, a ratio of the first distance to the second distance is smaller than 0.75, preferably smaller than 0.5 and most preferably smaller than 0.25. In other words, the second distance is significantly larger than the first distance. As a result, it can be avoided that the ventilated gas is arranged close to the transported powder, when powder and gas exit the respective opening.

Preferably, the dispensing device further includes a lid element configured to be attached to the second side of the device so as to cover the power passage and the ventilation passage.

According to a further aspect of the disclosure, the lid element is configured as a cover to close the powder passage and the ventilation passage. The lid element is removably attachable to the dispensing device (i.e. at the second side of the dispensing device). The lid element is configured so as to also cover a protrusion extending from the second side of the dispensing element. The lid element includes a snap fit mechanism to be removably attached to the dispensing device. Alternatively, the lid element is permanently attached to the dispensing device and is configured to be moveable between an open position and a closed position. Preferably, the lid element is moveably fixed to the dispensing device via an integral hinge. However, the lid element may be attached to the dispensing device using any other suitable connection means.

Preferably, the dispensing device has an internal thread at the second side of the device, wherein the lid element has an external thread so as to be screwed to the internal thread of the device. The additional advantage is that the lid element can have a second use, namely that once the container is empty, the dispensing device could be removed and discarded and then the container can be closed by means of the lid element. In case such container is e.g. an aluminum bottle, the lid element closes such bottle which can be used as a drinking bottle for many years and does not have to be thrown away. The lid element has a multifunctional purpose.

According to a further aspect of the disclosure, the lid element is securely fixed to the dispensing device. Further, the internal thread of the dispensing device at the second side also fits to the thread of the container. In other words, the external thread of the lid element is the same thread as the external thread of the dispensing device at the first site. As a result, the lid element may be also screwed directly to the container without providing the dispensing device between the container and the lid element. Hence, a multiple use of the lid element is made possible.

Preferably, the lid element comprises a sealing element so as to hermetically seal the powder passage and the ventilation passage, if the lid element is attached to the dispensing device.

According to a further aspect of the disclosure, the powder within the container is reliably protected from humidity if the lid element is attached to the dispensing device. As a result, the aging of the powder accommodated within the container is significantly slowed down. Therefore, the powder may be stored over a long term without being deteriorated.

Preferably, the lid element is made of aluminum or plastic.

According to a further aspect of the disclosure, the lid element is a barrier for humidity. Thus, an introduction of humidity into the container is reliable prevented.

According to a further aspect of the present disclosure a dispensing system is provided, the dispensing system comprising: a dispensing device as defined above, a closed container including an opening at which the dispensing device is attachable, wherein the container is preferably an aluminum bottle.

According to a further aspect of the disclosure, the container is an air tight container. As a result, the aging of the powder is suppressed or slowed down because no humidity enters into the container.

Preferably, the container has a wall thickness of 0.05 mm, preferably between 0.3 mm and 1.2 mm, more preferably about 0.9 mm.

According to a further aspect of the disclosure, the container is configured to seal the powder accommodated within the container from being exhibited to humidity entering through the container wall. As a result, the aging of the powder is prevented or delayed.

The above features and advantages mentioned in connection with the dispensing device are also applicable to the system.

According to a further aspect of the present disclosure a method for dispensing powder is provided, the method comprising the steps of: providing a container having a sealed opening and including powder, opening of the opening, attaching a dispensing device as defined above to the opening, and inclining the container such that the ventilation passage of the device is above the powder passage with respect to the direction of gravity.

The advantages and features described in connection with the device are also applicable to the method and vice versa.

Wherever not already described explicitly, individual embodiments or their individual aspects and features can be combined or exchanged with one another without limiting or widening the scope of the described disclosure, whenever such a combination or exchange is meaningful and in the sense of this disclosure. Advantages, which are described with respect to one embodiment of the present disclosure are, wherever applicable also advantages of other embodiments of the present disclosure.

DETAILED DESCRIPTION

Figure 1:
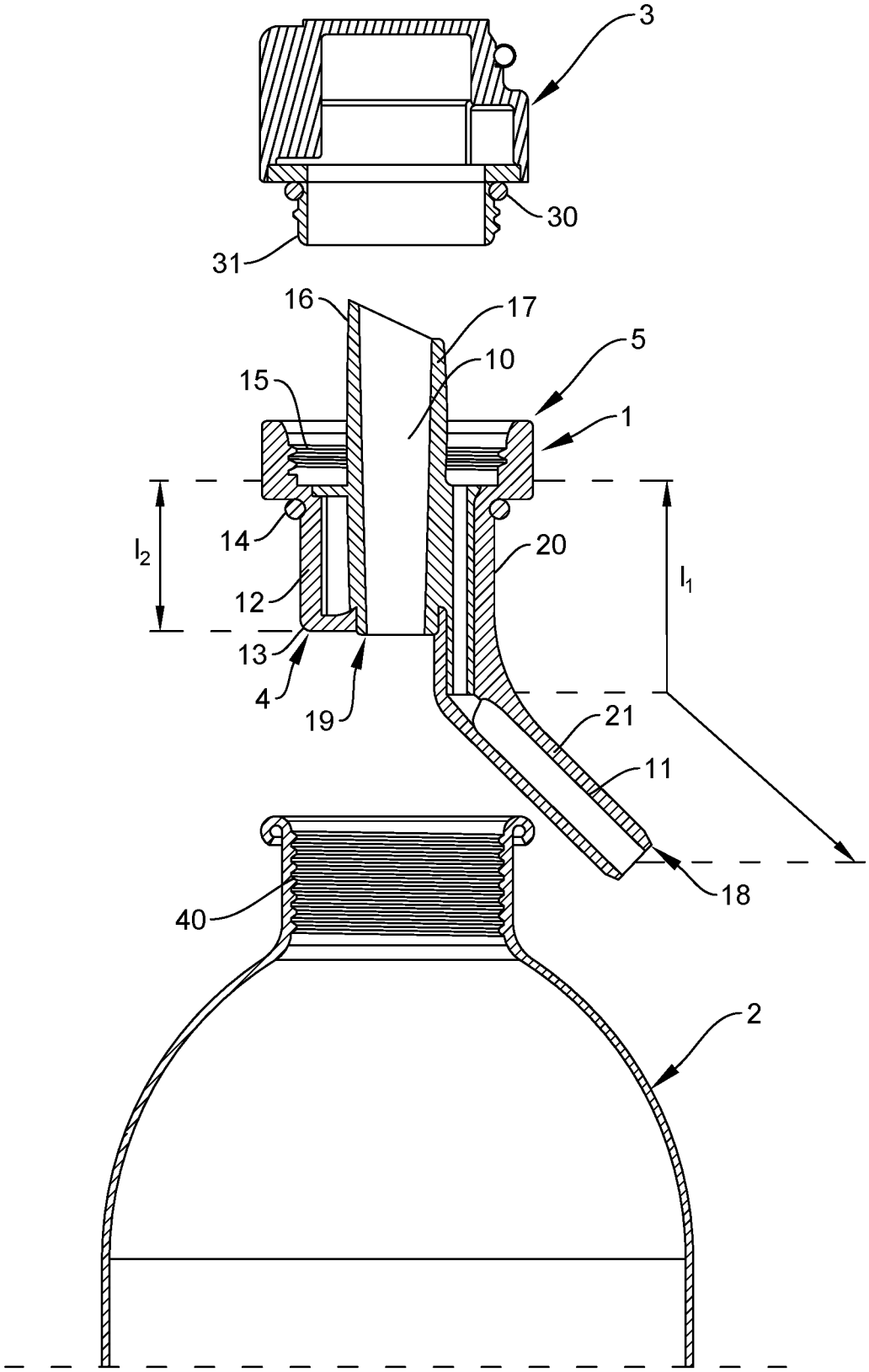
FIG. 1*a* schematic sectional view of a dispensing system and a lid element according to an embodiment of the present disclosure, wherein the elements are spaced from each other, FIG. 2*a* schematic sectional view of a dispensing system and a lid element according to an embodiment of the present disclosure, wherein the elements are attached to each other, FIG. 3*a* schematic sectional view of a dispensing device and according to an embodiment of the present disclosure and a container, and FIG. 4 a schematic sectional view of a dispensing device and according to an embodiment of the present disclosure and a container in the discharge position.

FIG. 1 shows a sectional view of a dispensing device 1, a lid element 3 and a container 2 (the container is depicted only partly). First, the dispensing device 1 will be described.

In the present embodiment, the dispensing device 1 is a circular cap configured to be 30 screwed to an opening of the container 2. The dispensing device 1 has a first side 4 facing towards the container 2 and a second side 4 facing away from the container 2. The dispensing device 1 comprises a dispensing device body 12. Further, the dispensing device 1 includes a powder passage 10 extending through the dispensing device 1 (i.e. through the body 12) along a central axis C. The powder passage 10 is arranged within the dispensing device 1 so as to be centralized in the dispensing device 1. The powder passage 10 has a powder opening 19 opposite to the second side 5. The powder passage 10 is configured to transfer a powder 50 from the first side 4 to the second side 5. That is, from an inside of the container 2 to an outside of the container 2. Accordingly, the powder 50 may enter the powder passage 10 through the powder opening 19 at the first side 4 of the dispensing device 1. The powder opening 19 at the first side 4 of the dispensing device 1 is flush with a surface of the body 12 of the dispensing device 1 (i.e. the powder opening 19 is flush with a surface of the body 12 at the first side 4). At the second side 5 the powder passage 10 has a protrusion 17 that protrudes from the second side 5. That is, the protrusion 17 protrudes from the body 12 at the second side 5. In addition, the protrusion 17 has a spout 16 to allow a defined dispensing of the powder 50. The powder passage 10 has a powder passage length 12 measured from the surface of the body 12 at the second side 5 to the powder opening 19 at the first side 4.

Further, the dispensing device 1 has a ventilation passage 11 extending through the dispensing device 1 (i.e. through the body 12). The ventilation passage 11 is eccentrically arranged in the dispensing device 1. The ventilation passage 11 is composed of an inner or internal portion 20 and an outer or external portion 21. The inner portion 20 extends through the body 12. The external portion 21 extends outside of the body 12. That is, the external portion 21 protrudes from the first side 4 of the dispensing device 1. The inner portion 20 extends parallel to the central axis C. The external portion 21 is inclined with respect to the central axis C. The ventilation portion 11 has a ventilation opening 18 opposite to the second side 5. That is, the ventilation opening 18 is closer to the first side 4 than to the second side 5. In more detail, the external portion 21 of the ventilation passage 11 has the ventilation opening 18. Moreover, the ventilation passage 11 has a first passage length 11. In more detail, the first passage length 11 is measured from the surface of the body 12 at the second side 5 to the ventilation opening 18. The first passage length 11 is longer than the second passage length 12. As a result, the ventilation opening 18 is spaced apart from the powder opening 19. That is, even if the container 2 is tiled in order to discharge powder 50 out of the container 2, the ventilation passage 11 may be in communication with the air volume within the container 2.

In addition, the dispensing device 1 has an external thread 13 such that the dispensing device 1 may be screwed to an internal thread 40 of the container 2. The dispensing device 1 further includes a sealing means 14 which is arranged on the body 12 of the dispensing device 1 adjacent to the external thread 13 of the dispensing device 1 so as to seal between the dispensing device 1 and the container 2 if both are connected to each other. Moreover, the dispensing device 1 has an internal thread 15 at the second side 5 of the dispensing device 1. The internal thread 15 is configured to be connected to a lid element 3 to be described below.

Moreover, the external portion 21 of the ventilation passage 11 is made of a rigid material. The length and/or the inclination of the external portion 21 is configured such that it may pass through the opening of the container 2 if the dispensing device 1 is attached to the container 2. In a further not depicted embodiment the external portion 21 is made of an elastic material. As a result, the external portion may have a longer extension. That is, the external portion 21 may be deformed during the insertion thereof into the container 2. If the external portion 21 is located within the container 2 it may take its original form due to its elasticity.

Accordingly, it is possible to provide a ventilation passage 11 which reliably is in communication with the air volume within the container 2 even if the container is almost completely filled with powder and/or inclined.

Second, the container 2 is a closed and rigid container made of aluminum. In the present embodiment the container 2 has the shape of a bottle. The container 2 has only one opening at one axial side thereof. The container 2 has the inner thread 40 at its opening to which the external thread 13 of the dispensing device 1 may be connected by screwing in. Further, the container 2 has a wall thickness of 0.9 mm. As a result, the container is air tight such that no humidity from the ambient air may pass through the wall of the container 2 into the inside of the container 2. As a result, the powder 50 accommodated within the container 50 is less prone to aging due to being exposed to humidity.

Advantageously, the container 2 is filled with powder 50 is closed with a foil (not shown) glued on the rim the opening. In a further embodiment, the foil is made of aluminum. The foil is removed prior to using the dispensing device 1 with the container 2.

Third, the lid element 3 includes an external thread 31 configured to be threaded to the internal thread 15 of the dispensing device 2 so as to cover the second side 5 of the dispensing element 1. Further, the lid element 3 includes a sealing element 30 configured to seal between the lid element 3 and the dispensing device 1 if both are attached to each other.

Figure 2:
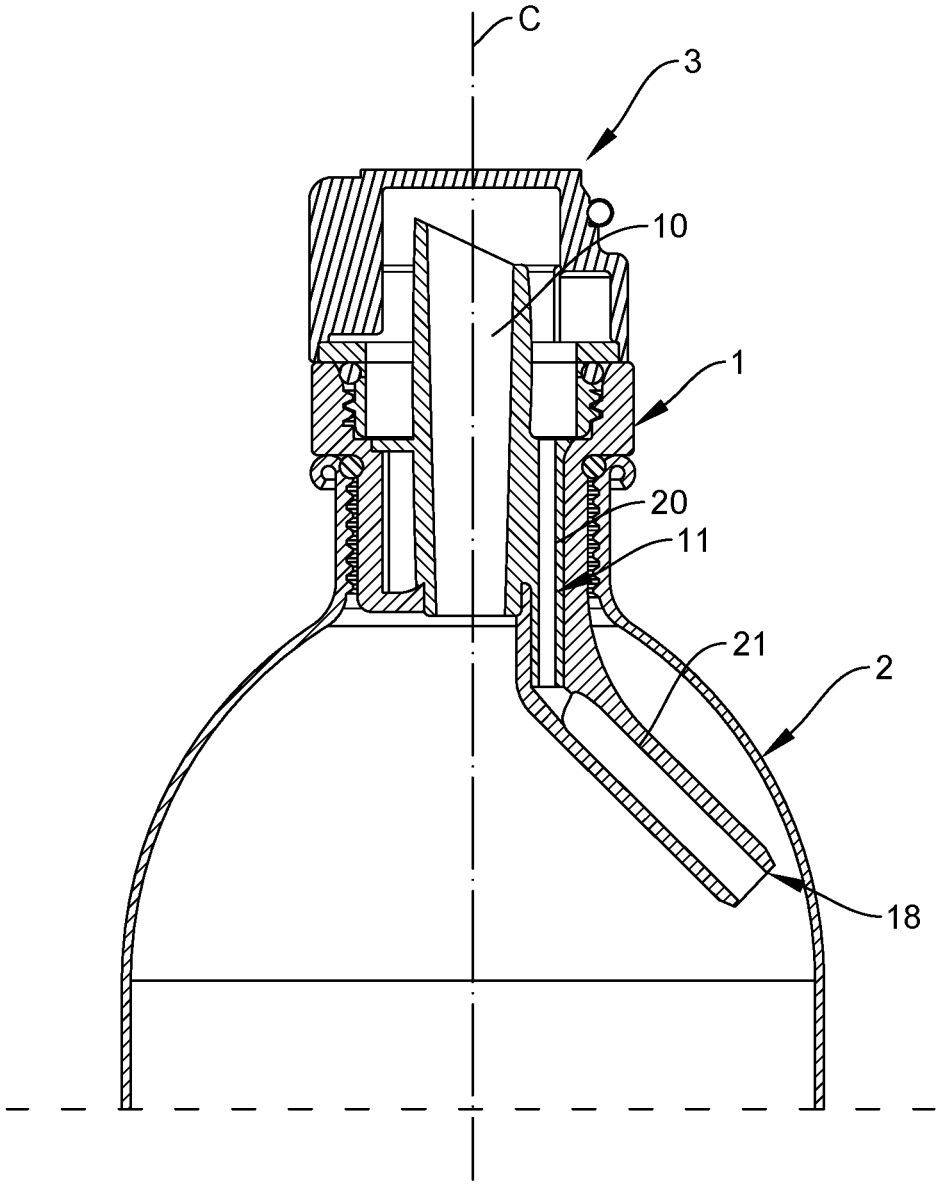

In FIG. 2 the lid element 3 is attached to the dispensing device 1. Further, the dispensing device 1 is attached to the container 2. In the present embodiment the ventilation opening 18 is located closer to the inner wall of the container 2. This provides the effect that if the container 2 is inclined as far as being in the discharge position, then powder 50 may be dispensed through the powder passage 10, the ventilation passage is still in a position to introduce air through the ventilation passage 11 into the container 2. Therefore, the powder 50 may be smoothly and continuously dispensed.

Figure 3:
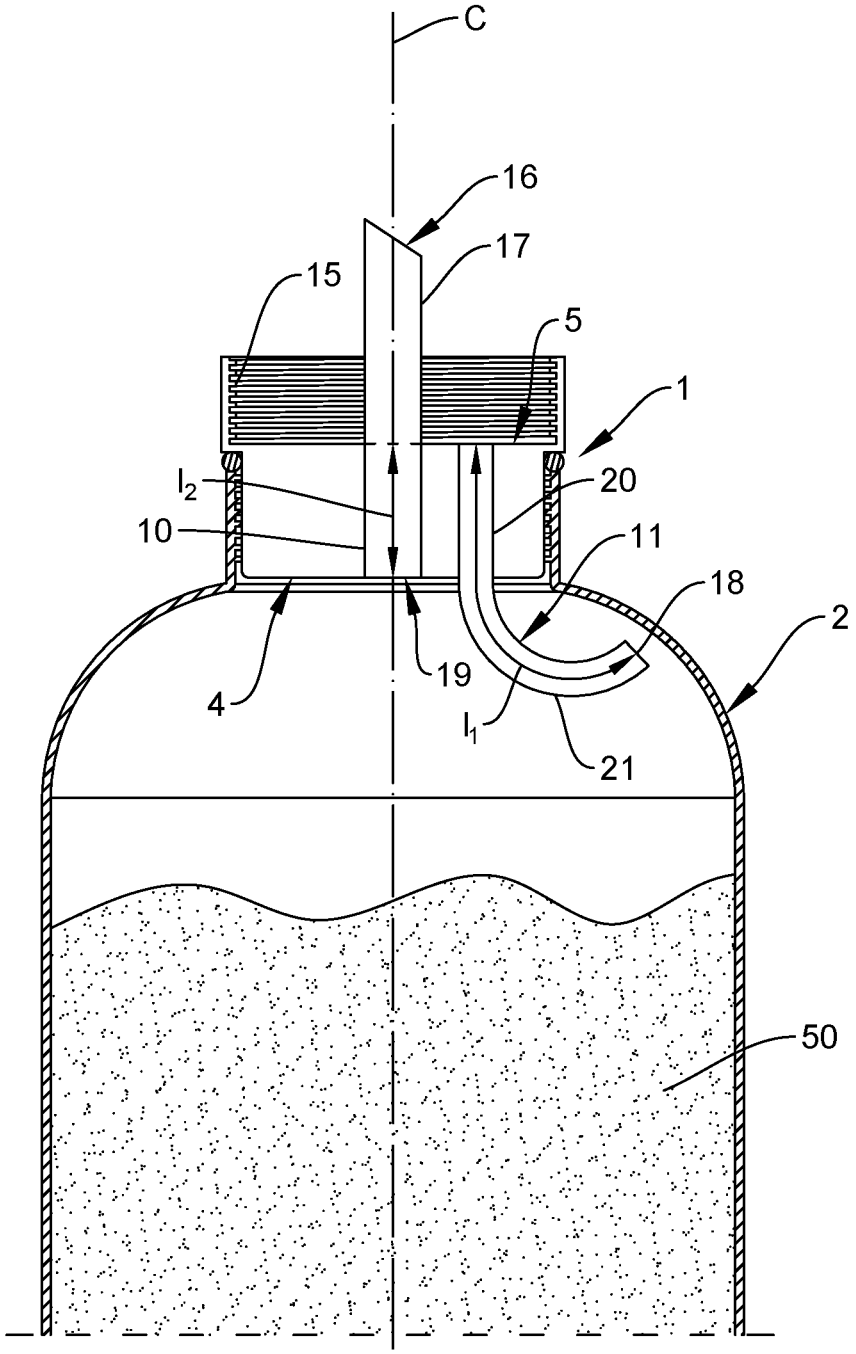

In FIG. 3 a further embodiment of the present disclosure is depicted. The present embodiment differs from the above embodiment in that the external portion 21 of the ventilation passage 11 is curved. Accordingly, the powder 50 is not easily introduced into the ventilation passage 11 if the container 2 is inclined. In addition, in FIG. 3 the lid element 3 is not displayed, but may also attached to the dispensing device 1 as in the embodiment depicted in FIG. 2.

Figure 4:
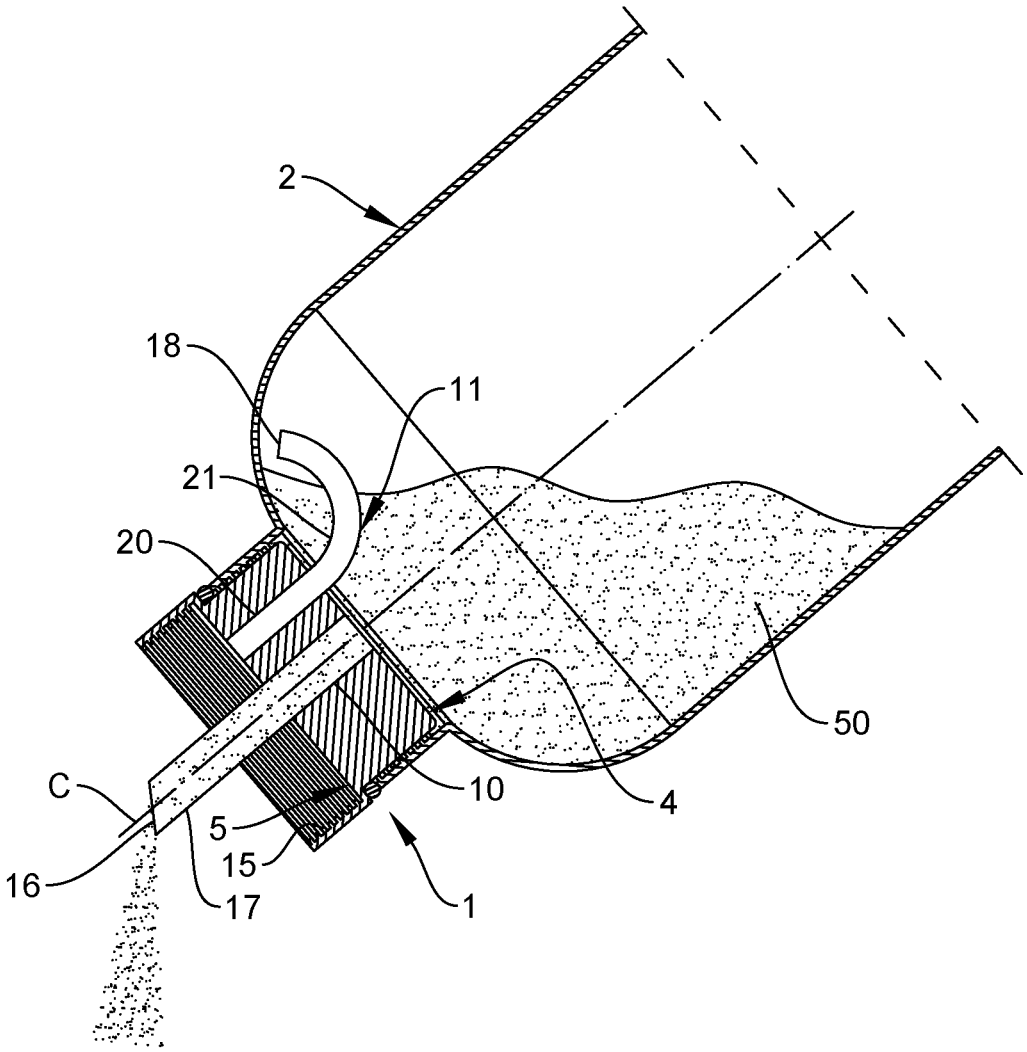

In FIG. 4 the same embodiment as depicted in FIG. 3 is depicted. However, in FIG. 4 the container 2 and the dispensing device 1 attached to the container 2 are inclined into the discharge position so as to dispense powder out of the container 2. The ventilation opening 18 is in communication with the air volume inside the container 2. That is, the external passage 21 extends through the layer of powder 50 and then extends into the air volume. As a result, a smooth and continuous dispensing of powder 50 out of the container 2 may be secured.

In a further not depicted embodiment the external portion 21 of the ventilation passage 11 extends almost up to the bottom of the container 2. Therefore, an introduction of air into the container 2 may be realized even if the container 2 is inclined so as to be positioned upside down.

In the following the method of dispensing powder using the dispensing device 1 according to the present disclosure will be described. First, the dispensing device 1 is attached to the container 2. In this state the container 2 stands upright. Subsequently, the user may incline the container 2 such that the protrusion portion 17 is directed towards a target to be filled with powder 50. In addition, the container 2 is oriented such that the spout 16 is located at a lower position of the protrusion 17 with respect to gravity. Therefore, inside the container 2, the ventilation passage 11 is automatically arranged above the powder passage 10. That is, the spout 16 is used as mark for knowing how the container 2 has to be oriented during the dispensing process. However, every other suitable mark may be used to identify how to hold the container 2. Due to the fact that the ventilation opening 18 is located above the powder opening 19, air can easily enter the container 2 through the ventilation passage 11. As a result, through the powder passage 10 only powder 50 is discharged. Consequently, the powder 50 may be smoothly discharged out of the container 2 without spilling powder 50.

If the target to be filled with powder 50 is sufficiently filled, the container 2 is positioned in an upright position. In order to avoid aging of the powder 50, the container 2 may be covered with the lid element 3 in order to hermetically seal the container 2. Since the lid element 3 may be attached to both the dispensing device 1 and the container 2, it is up to the user to decide whether the dispensing device 1 should be left on the container or not. In any case the powder 50 may be stored within the container 2 in a hermetically sealed manner.

The invention claimed is:

1. Dispensing device for dispensing a powder, wherein the device has a first side and a second side, the dispensing device comprising:

a powder passage extending through the device and being configured to transfer powder from the first side to the second side, and a ventilation passage extending through the device and being configured to transfer ambient air from the second side of the device to the first side of the device, wherein the ventilation passage has a first passage length from a surface of the second side up to a ventilation opening, wherein the powder passage has a second passage length from the surface of the second side up to a powder opening, and wherein the first passage length is longer than the second passage length; wherein the device further includes a lid element configured to be attached to the second side of the device so as to cover the powder passage and the ventilation passage.

2. Dispensing device according to claim 1, wherein the ventilation passage has an inner portion extending in between said first side and said second side and an external portion extending outside of the device at the first side, into a direction opposite to the second side.

3. Dispensing device according to claim 2, wherein the external portion is inclined with respect to the powder passage and/or the inner portion.

4. Dispensing device according to claim 1, wherein the powder passage has a protrusion portion protruding from the second side of the device.

5. Dispensing device according to claim 4, wherein the protrusion portion has a spout extending from the protrusion portion.

6. Dispensing device according to claim 5, wherein the spout is arranged at the protrusion portion so as to be located at the opposite side of the ventilation passage with respect the powder passage.

7. Dispensing device according to claim 1, wherein the device includes an external thread such that the device is screwed to a thread on an opening of a container such that the first side is facing the inside of the container.

8. Dispensing device according to claim 1, wherein the powder can be transported through the powder passage along an ejection direction, wherein the powder passage has a cross section with a first size measured in a plane being perpendicular to the ejection direction and the ventilation passage has a cross section with a second size, measured in the plane perpendicular to the ejection direction, wherein a ratio of the second size to the first size is smaller than 0.75.

9. Dispensing device according to claim 1, wherein a-second size of the cross section of the ventilation passage increases from the second side to the ventilation opening.

10. Dispensing device according to claim 1, wherein the powder passage extends straight and/or has a cross section with a constant first cross section along an extension of the powder passage from the second side to the powder opening, the first cross section being measured along a direction being parallel to an ejection direction, along which the powder is transported.

11. Dispensing device according to claim 1, wherein the dispensing device has a cylindrical basic shape having a central axis, wherein measured in a radial direction with respect to the central axis a first distance is established between an opening of the ventilation passage at the second side and an opening of the powder passage at the second side, and a second distance is established between the powder opening and the ventilation opening, a ratio of the first distance to the second distance is smaller than 0.75.

12. Dispensing device according to claim 1, wherein the device has an internal thread at the second side of the device, wherein the lid element has an external thread so as to be screwed to the internal thread of the device.

13. Dispensing system comprising:

the dispensing device according to claim 1, a closed container including an opening at which the dispensing device is attachable, wherein the container is an aluminum bottle.

14. Dispensing system according to claim 13, wherein the container has a wall thickness of 0.05 mm.

15. Method for dispensing the powder comprising the steps of:

providing a container having a sealed opening and including the powder, opening the sealed opening, attaching the dispensing device according to claim 1 to the opening, and inclining the container to a discharge position such that the ventilation passage of the device is above the powder passage with respect to a direction of gravity.

* * * * *